US006976896B2

(12) United States Patent
Eberhardt et al.

(10) Patent No.: US 6,976,896 B2
(45) Date of Patent: Dec. 20, 2005

(54) METHOD FOR PRODUCING A FLAT GAS DISCHARGE LAMP

(75) Inventors: Angela Eberhardt, Augsburg (DE); Michael Ilmer, Rott am Inn (DE); Michael Seibold, Munich (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 255 days.

(21) Appl. No.: 09/958,486

(22) PCT Filed: Jan. 9, 2001

(86) PCT No.: PCT/DE01/00043

§ 371 (c)(1),
(2), (4) Date: Feb. 19, 2003

(87) PCT Pub. No.: WO01/61721

PCT Pub. Date: Aug. 23, 2001

(65) Prior Publication Data

US 2005/0176333 A1 Aug. 11, 2005

(30) Foreign Application Priority Data

Feb. 15, 2000 (DE) ..... 100 06 750

(51) Int. Cl.[7] ..... H01J 9/00
(52) U.S. Cl. ..... 445/24; 445/23
(58) Field of Search ..... 313/582–587; 445/24, 25

(56) References Cited

U.S. PATENT DOCUMENTS 5,754,003 A * 5/1998 Murai et al. ..... 313/582
6,469,435 B1 * 10/2002 Seibold et al. ..... 313/493

* cited by examiner

*Primary Examiner*—Joseph L. Williams
(74) *Attorney, Agent, or Firm*—Robert F. Clark

(57) ABSTRACT

A process for producing a discharge vessel of a flat gas discharge lamp, in which the discharge vessel has a base plate (1), a frame (3) and a cover plate (2), as well as at least one spacer (6) between base plate (1) and cover plate (2). At least between one of the plates (2) and the frame (3), at least one space (6) is initially kept open as a filling opening. By partial fusion of at least a part (4, 5) of the frame, which may also comprise a layer (4) of soldering glass and local elevations (5), the filling opening (6) is eliminated after the filling operation. The distance between the vessel plates (1, 2) is defined by the spacers (7), which remain hard even during the joining operation.

19 Claims, 2 Drawing Sheets

METHOD FOR PRODUCING A FLAT GAS DISCHARGE LAMP

TECHNICAL FIELD

The invention relates to a process for producing a discharge vessel of a flat gas discharge lamp.

In particular, the invention is directed at the production of flat gas discharge lamps which are designed for dielectric barrier discharges, in which, therefore, at least the electrodes of one polarity are separated from the discharge volume in the discharge vessel by a dielectric layer (dielectric barrier discharge lamps).

Lamps of this type are suitable not only for general lighting but also for the backlighting of liquid crystal displays (LCDs) and for decorative and advertising purposes.

PRIOR ART

Flat gas discharge lamps of the generic type have a discharge vessel which is formed by a base plate, a cover plate and a frame arranged between them. It should be noted that in the present application the technology of flat gas discharge lamps for dielectric barrier discharges is assumed to form the prior art. Moreover, by way of example, reference is made to document WO98/43277, the content of disclosure of which with regard to the technology of flat gas discharge lamps for dielectric barrier discharges is hereby incorporated by reference.

A flat discharge lamp of the generic type is known from DE 198 17 478 A1. The discharge vessel of this lamp comprises two plates which are parallel to one another, a frame and spacers which support the two plates with respect to one another. Each spacer comprises a component which has a high viscosity and a component which has a low viscosity at the joining temperature. Before the discharge vessel is joined together, the vertical dimension of each spacer is greater than the intended final spacing between the two plates. The peripheral gap-like opening which is initially kept clear as a result is used as a pump or filling opening for the discharge vessel. When the discharge vessel is being joined together, in each case the low-viscosity component of each spacer compensates for possible local deviations in the distances between the two plates.

EXPLANATION OF THE INVENTION

It is an object of the present invention to provide an improved process for producing discharge vessels of gas discharge lamps.

This object is achieved by a process having the features of claim 1.

Preferred configurations of the invention form the subject matter of the dependent claims.

According to the invention, during production at least one space is initially held open at least between one of the two discharge vessel plates and the frame, to act as a pump and filling opening. After purge gases and possible volatile contaminants have been pumped out and the vessel has then been filled with the fill gas or gases, for example Xenon, the filling opening is eliminated as a result of at least part of the frame being partially fused. Moreover, at least one spacer is arranged between base plate and cover plate, for example in the form of a ball, column or the like. During the joining operation described above, the spacers are not softened or fused at all, but rather remain hard. This ensures that the distance between base plate and cover plate is defined by the vertical dimension of the or each spacer.

Compared to the prior art, it is in this case possible to dispense with the low-viscosity component of the spacers. Particularly in the case of large-area lamps or lamps with relatively thin vessel plates, which consequently require a relatively large number of spacers for stability reasons, this represents a considerable saving on material and manufacturing outlay.

The discharge vessel individual parts are usually joined in a furnace. At the joining temperature, which is typically a few hundred degrees Celsius, for example approx. 500° C., according to the invention the frame or at least the appropriate part of the frame then softens, but the two vessel plates and the spacers do not. To achieve this effect, the frame or that part of the frame which is intended to soften, which may also comprise a separate layer of soldering glass or a local elevation, is selected from a material with a viscosity which is relatively low, for example approx. $10^6$ dPa s (dezi-pascal second) or less, at the joining temperature. Examples of suitable materials include soldering glass or sintered glass materials, for example comprising Pb—Si—B—O, Bi—Si—B—O, Zn—Si—B—O, Zn—Bi—Si—B—O, Sn—Zn—P—O. By contrast, the two vessel plates and the spacers, as well as, if appropriate, the remaining part of the frame are selected from a material with a viscosity which is relatively high, for example approx. $10^{10}$ dPa s or more, at the joining temperature. Examples of suitable materials for this purpose are soft glass materials and crystallized soldering glass materials or composite solders and stable soldering glass materials with a high softening point, e.g. Bi—Si—B—O, Sn—Zn—P—O, Zn—B—Si—O, Pb—B—Si—O and Zn—Bi—Si—B—O.

By way of example, the filling opening can be produced by selecting the height of the spacers to be greater than the height of the uniformly surrounding frame. The result is a gap between the frame and one of the two plates. After the filling operation, the gap is closed by softening or partial fusion of the frame. If the frame is joined to the upper cover plate, i.e. the gap is between the base plate and the frame, the closing operation is assisted by the forces of gravity, so that in this way it is possible to close up even relatively large gaps without problems. Further details in this respect are given in the description of the exemplary embodiments.

As an alternative, the filling opening can be produced by a sealing surface between one of the vessel plates and the frame being uneven. By way of example, the sealing surface may be corrugated or may be elevated at at least one distinct point. Suitable elevations are, for example, prefabricated sintered glass parts which are arranged on the frame. Alternatively, the elevations may also be formed integrally with the remaining part of the frame. By way of example, the elevations can also be produced as a result of the frame being assembled from individual parts, if the joins between the individual parts have previously been partially fused, for example by means of a laser. In this case, the elevations are formed from the partially fused material during joining of the individual frame parts.

DESCRIPTION OF THE DRAWINGS

In the text which follows, the invention is explained in more concrete terms on the basis of a plurality of exemplary embodiments; the features disclosed during this explanation may be pertinent to the invention both individually and in combinations other than those illustrated. In the drawings.

Figure 1:
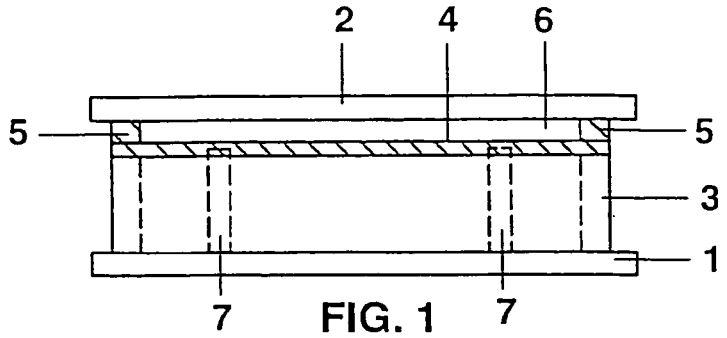
FIG. 1 shows a diagrammatic side view of a flat radiator discharge vessel before the inventive closure, according to a first exemplary embodiment in accordance with the invention.

The first exemplary embodiment, which is shown in FIG. 1, has a base plate 1 and cover plate 2, and also a frame 3 made from soft glass. The frame 3 may be joined to the base plate 1 in various ways or may be formed integrally therewith. In particular, it could also be joined to the base plate 1 by partial glass fusion caused by light radiation (joining by means of laser radiation). The resulting discharge vessel is substantially rectangular in cross section and its contour (not shown) is also rectangular. It is used to produce a flat radiator with dielectric barrier discharges for backlighting of a flat screen or for general lighting purposes. Accordingly, electrode strips are printed onto that side of the base plate 1 which lies at the top in the figure, inside the frame 3, some of the electrodes being covered with a dielectric layer. These details are of no further interest here and are therefore not shown. Reference is made to the content of the disclosure of WO98/43277, which has already been cited.

However, the exemplary embodiment shown in FIG. 1 serves to illustrate the way in which the cover plate 2 is connected to the frame 3. For this purpose, a layer of soldering glass with upper side 4 is applied to the frame 3 and, in the corners of the discharge vessel, is locally elevated by means of small columns 5 of sintered glass. In the remaining region, the cover plate 2 lies above the top side 4 of the support, i.e. the sealing surface, at a distance which corresponds to the difference in height between the columns 5 and the remaining support 3.

In this exemplary embodiment, columns 5 are provided in all four corners of a flat radiator discharge vessel of rectangular contour. Accordingly, four spaces 6 result between the sealing surface 4 and the cover plate 2, in each case corresponding to one side of the rectangular contour. The height of the columns 5 can also be adapted according to the demands imposed on the line cross section for evacuation and filling of the discharge vessel.

Four column-like spacers 7 made from soft glass (only two of which are visible) are arranged standing on end, at uniform distances from one another, on the base plate 1.

After the operation of filling with the fill gas—in this case xenon—the individual parts described above are joined to form the discharge vessel by heating in a furnace (not shown). The temperature in the furnace is increased to such an extent that the soldering glass 4 and the sintered glass columns 5 soften, i.e. adopt a viscosity of typically less than $10^6$ dPa s. As a result, the cover plate 2 sinks onto the sealing surface 4 of the frame 3 or the spacers 7. In this way, full closure of the discharge vessel is achieved over the entire upper periphery of the frame 3, i.e. over the entire sealing surface 4. This typically requires temperatures of 520° C. The distance between cover plate 2 and base plate 1 results from the height of the hard spacers 7, the viscosity of which is typically more than $10^{10}$ dPa s at the joining temperature.

This embodiment is preferably used for frame heights of over approx. 3 mm. A further advantage is that the size of the pumping or filling opening 6 can be influenced relatively easily by means of the height of the columns 5.

In a variant (not shown) the frame is assembled from at least two individual parts made from crystallized soldering glass or composite solder, for example Bi—Si—B—O, Sn—Zn—P—O, Zn—B—Si—O or Zn—Bi—Si—B—O, in one plane. For this purpose, the individual frame parts are fused together in a vacuum-tight manner by means of sintered-glass parts, e.g. comprising Pb—Si—B—O, Sn—Zn—P—O, Bi—B—Si—O or Zn—Si—B—O. The sintered-glass parts are deliberately selected to be higher than the individual frame parts. The elevations of the frame produced in this way result in spaces for filling, in a similar way to the exemplary embodiment above. At their sealing surfaces, the individual frame parts are provided with a sintered-glass layer. At the joining temperature during the joining operation in the furnace, the individual frame parts, the two plates and the spacers remain hard, whereas the sintered-glass layer and the sintered-glass parts soften. This causes the cover plate to sink onto the appropriately dimensioned spacers in such a manner that the filling opening is closed as a result of frame and vessel plate being joined together.

This variant is also preferably used for frames of heights of over approx. 3 mm. Moreover, this frame comprising a plurality of individual parts is less expensive than a single-part frame.

Figure 2:
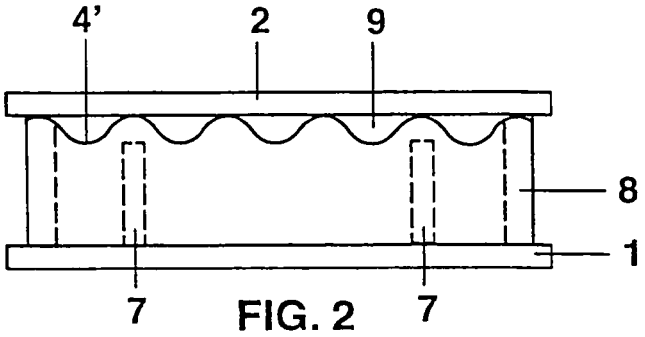
FIG. 2 shows a diagrammatic side view of a further exemplary embodiment of the invention.

A further exemplary embodiment, relating to a flat radiator of the type mentioned in the first exemplary embodiment, is shown in FIG. 2. In this case, a frame 8 between the base plate 1 and the cover plate 2 consists of soldering glass (at least in the upper region). The upper region of the frame 8 and the sealing surface 4' resting thereon are corrugated, so that the cover plate 2 bears against the frame 8 at a relatively large number of locations, between each of which there are individual filling openings 9—corresponding to the valleys of the corrugation. As a result of at least the upper region of the frame 8 being softened or partially fused, in particular in the region of the crests of the corrugation, in this case too the cover plate 2 sinks onto the sealing surface 13' with surface-to-surface contact, thereby closing the discharge vessel. The desired distance between cover plate 2 and base plate 1 is in this case too produced by the suitably selected height of the spacers 7, which remain sufficiently hard at the joining temperature.

One advantage during production is the more stable position of the cover plate, on account of the numerous contact locations (corrugation crests). Moreover, it is in this way possible to achieve more uniform lowering of the cover plate during the joining phase. The risk of the cover plate being displaced or slipping is considerably reduced. However, the relatively high precision which is required during production of the frame represents a drawback.

Figure 3A:
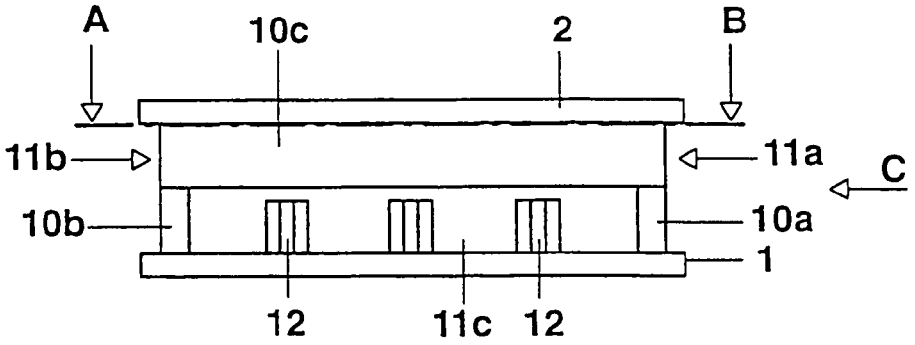
FIG. 3*a* shows a diagrammatic side view of a third exemplary embodiment of the invention.
Figure 3B:
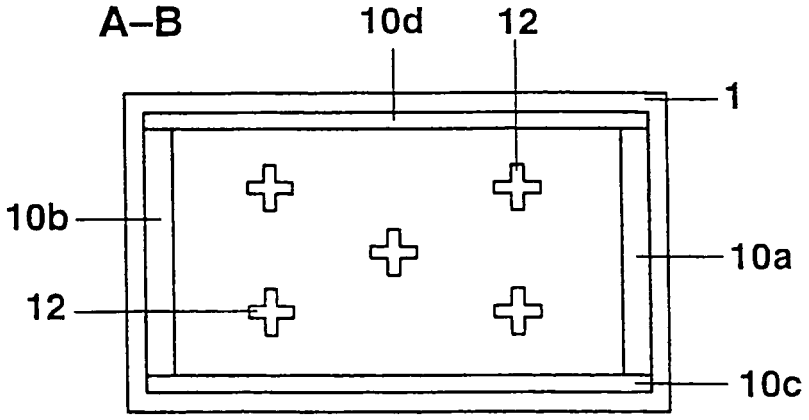
FIG. 3*b* shows a plan view of the exemplary embodiment shown in FIG. 3*a* on line AB.
Figure 3C:
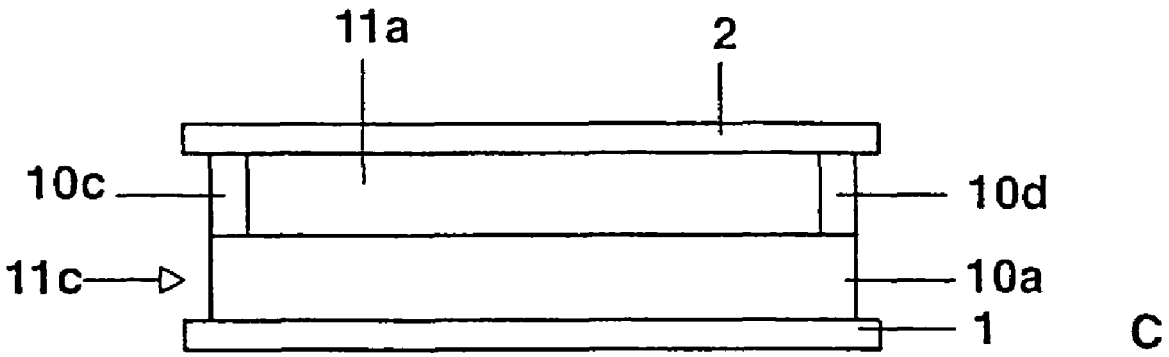
FIG. 3*c* shows a view of the exemplary embodiment shown in FIG. 3*a* as seen in the direction of arrow C.

FIGS. 3*a*, 3*b*, 3*c* show a diagrammatic side view, a plan view on line AB and a view as seen in direction C of a third exemplary embodiment of the invention. In this case, a frame between the base plate 1 and the cover plate 2 comprises four straight individual parts 10*a*–10*d* made from soldering glass. The first two individual frame parts 10*a*, 10*b* are arranged parallel to one another directly on the base plate 1 (forming a first layer). The remaining two individual frame parts 10*c* and 10*d* are in each case at right angles thereto and are placed onto in each case one end of the first two individual frame parts 10*a*, 10*b* (second layer). In this way, the cover plate 2 is initially arranged at a distance of twice the height of each individual part 10*a*–10*d* from the base plate 1. In this case, the four gaps 11*a*–11*d*—two in each of the two layers—which are formed as a result of the two times two individual frame parts 10*a*, 10*b* and 10*c*, 10*d* being in layers which are offset by 90°, function as filling openings.

Five column-like spacers 12 are arranged standing on end and at constant distances from one another on the base plate 1. The cross section of each spacer 12 is in the form of a cross. With a view to minimizing the visibility of the spacers 12 when the illuminating cover plate 2 is looked at, this shape has proven appropriate.

The joining of the individual parts described above to form the discharge vessel takes place in a similar way to the method described above, through heating in a furnace (not shown). When the individual frame parts 10*a*–10*d* soften or partially fuse, the two upper individual frame parts 10*c*, 10*d*, including the cover plate 2, sink downward and thereby close off the discharge vessel. The desired distance between cover plate 2 and base plate 1 is once again produced by an appropriately selected height of the spacers 12, which are still sufficiently hard at the joining temperature.

An advantage of this embodiment is that the individual parts can be prefabricated. Moreover, pour-free glass bodies, with consequently reduced outgasing during the joining phase, can be used for this purpose. Consequently, it is possible to achieve a better purity of gas within the closed discharge vessel. A drawback is the relative difficulty of positioning the individual frame parts. Moreover, the filling openings are restricted to the height of the individual frame parts.

Figure 4:
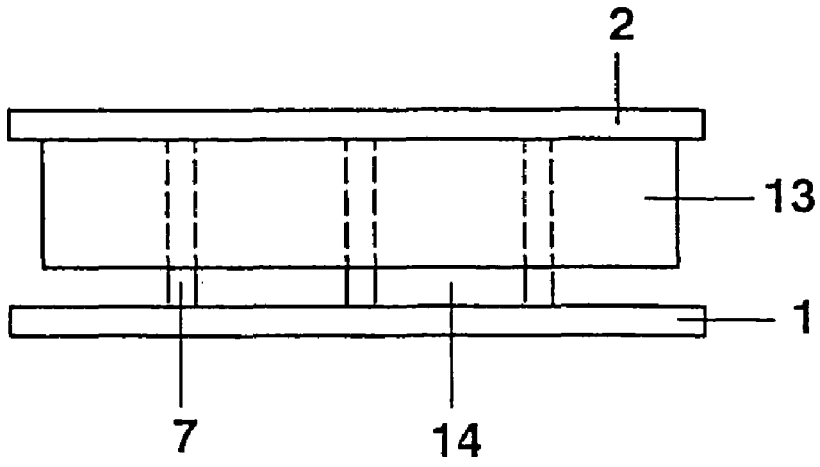
FIG. 4 shows a diagrammatic side view of a fourth exemplary embodiment of the invention.

The fourth exemplary embodiment, which is diagrammatically illustrated in FIG. 4, has a base plate 1 and a cover plate 2 made from soft glass. Five column-like spacers 7 (only three of which are visible) made from soft glass are arranged standing on end on the base plate 1. The cover plate 2 rests on the spacers 7. A frame 13, which is connected to the cover plate 2, is arranged between base plate 1 and cover plate 2. Its height is deliberately selected in such a manner that initially a gap 14, which functions as a filling opening, remains between the frame 13 and the base plate 1. The frame 13 consists of soldering glass.

After the filling operation, the discharge vessel is closed in a gastight manner by heating in a furnace. In the process, the softened frame 13 moves downward to the base plate 1, so that the latter is joined to the frame 13.

After controlled cooling (to avoid stresses), the discharge vessel is suitable for further use.

This embodiment is preferably used for frame heights of up to approx. 3 mm. This is a relatively inexpensive process. The frame may be applied directly to the cover plate, initially in paste form, for example by means of a dispenser. In the process, the frame can be shaped as desired. Moreover, it is possible to produce different frame contours, for example round or polygonal. However, a drawback is that there is usually a high level of outgasing of the frame paste during the joining process. This may have an adverse effect on the gas purity. Moreover, a relatively precise temperature control is required during the joining process.

What is claimed is:

1. A process for producing a discharge vessel of a flat gas discharge lamp, comprising:

(a) forming an assembly of a base plate, at least one spacer, a frame and a cover plate, the frame comprising first and second layers each having two straight individual frame parts that are arranged parallel to and at a distance from one another, the individual frame parts of the first layer being arranged on the base plate and at right angles to the individual frame parts of the second layer, ends of individual frame parts of the second layer being placed on ends of the individual frame parts of the first layer so that two filling openings are formed in each layer, the cover plate being arranged on the frame, (b) filling the assembly with a gas, (c) heating the assembly at a joining temperature to soften the individual frame parts, close the filling openings and join the frame parts to each other and to the base and cover plates, the at least one spacer remaining sufficiently hard during the heating to define a distance between the cover plate and the back plate.

2. The process of claim 1 wherein the individual frame parts are made of a soldering glass.

3. The process of claim 1 wherein the at least one spacer has a viscosity of more than $10^{10}$ dPa s at the joining temperature.

4. The process of claim 1 wherein the individual frame parts have a viscosity of less than $10^{6}$ dPa s at the joining temperature.

5. A process for producing a discharge vessel of a flat gas discharge lamp, comprising:

(a) forming an assembly of a base plate, at least one spacer, a frame and a cover plate, the frame being joined to the base plate and having a sealing surface, the cover plate being spaced apart from the sealing surface by columns in order to form filling openings between the cover plate and the frame, (b) filling the assembly with a gas, (c) heating the assembly to a joining temperature to soften the columns in order to cause the cover plate to contact the at least one spacer, join the cover plate to the frame, and close the filling openings, the at least one spacer remaining sufficiently hard during the heating to define a distance between the cover plate and the back plate.

6. The process of claim 5 wherein the discharge vessel is substantially rectangular and the columns are located at each corner of the discharge vessel.

7. The process of claim 5 wherein the sealing surface is comprised of a layer of soldering glass.

8. The process of claim 7 wherein the columns are comprised of a sintered glass.

9. The process of claim 5 wherein the at least one spacer has a viscosity of more than $10^{10}$ dPa s at the joining temperature.

10. A process for producing a discharge vessel of a flat gas discharge lamp, comprising:

(a) forming an assembly of a base plate, at least one spacer, a frame and a cover plate, the frame having a sealing surface, the sealing surface being uneven and contacting the cover plate whereby filling openings are formed between the sealing surface and the cover plate, (b) filling the assembly with a gas, (c) heating the assembly at a joining temperature to close the filling opening and join the cover plate to the frame, the at least one spacer remaining sufficiently hard during the heating to define a distance between the cover plate and the back plate.

11. The process of claim 10 wherein the sealing surface is corrugated.

12. The process of claim 10 wherein the sealing surface is comprised of a soldering glass.

13. The process of claim 10 wherein the at least one spacer has a viscosity of more than $10^{10}$ dPa s at the joining temperature.

14. The process of claim 13 wherein the sealing surface has a viscosity of less than $10^6$ dPa s at the joining temperature.

15. A process for producing a discharge vessel of a flat gas discharge lamp, comprising:

(a) forming an assembly of a base plate, at least one spacer, a frame and a cover plate, the frame being joined to the cover plate, the base plate being spaced apart from the frame by the at least one spacer whereby a filling opening is formed between the base plate and the frame, (b) filling the assembly with a gas, (c) heating the assembly at a joining temperature to soften frame, close the filling opening, and join the base plate to the frame, the at least one spacer remaining sufficiently hard during the heating to define a distance between the cover plate and the back plate.

16. The process of claim 15 wherein the frame is comprised of a soldering glass.

17. The process of claim 15 wherein the frame has a viscosity of less than $10^6$ dPa s at the joining temperature.

18. The process of claim 15 wherein the at least one spacer has a viscosity of more than $10^{10}$ dPa s at the joining temperature.

19. The process of claim 18 wherein the frame has a viscosity of less than $10^6$ dPa s at the joining temperature.

* * * * *